US009840102B2

(12) United States Patent
Matsuda

(10) Patent No.: US 9,840,102 B2
(45) Date of Patent: Dec. 12, 2017

(54) THERMAL PRINTER

(71) Applicant: TOSHIBA TEC KABUSHIKI KAISHA, Shinagawa-ku, Tokyo (JP)

(72) Inventor: Okiharu Matsuda, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/262,194

(22) Filed: Sep. 12, 2016

(65) Prior Publication Data

US 2016/0375710 A1 Dec. 29, 2016

Related U.S. Application Data

(63) Continuation of application No. 14/677,078, filed on Apr. 2, 2015, now Pat. No. 9,463,640.

(51) Int. Cl.

| | |
|---|---|
| ***B41J 33/14*** | (2006.01) |
| ***B41J 11/00*** | (2006.01) |
| ***B41J 2/325*** | (2006.01) |
| ***B41J 25/304*** | (2006.01) |
| ***B41J 33/388*** | (2006.01) |

(52) U.S. Cl.

CPC ..... *B41J 33/14* (2013.01); *B41J 2/325* (2013.01); *B41J 11/007* (2013.01); *B41J 25/304* (2013.01); *B41J 33/388* (2013.01)

(58) Field of Classification Search

None

See application file for complete search history.

(56) References Cited

U.S. PATENT DOCUMENTS

2014/0036019 A1 2/2014 Mori
2014/0292989 A1 10/2014 Matsuda

OTHER PUBLICATIONS

Non-Final Office Action for U.S. Appl. No. 14/677,078 dated Jan. 15, 2016.

*Primary Examiner* — Matthew Luu
*Assistant Examiner* — Renee I Wilson
(74) *Attorney, Agent, or Firm* — Amin, Turocy & Watson LLP; Gregory Turocy

(57) ABSTRACT

A thermal printer comprises a sheet conveyance mechanism configured to convey a sheet formed by attaching labels on a mount; a ribbon conveyance mechanism configured to convey a ribbon; a thermal head configured to heat the ribbon to carry out printing of printing data on the sheet contacted with the ribbon; and a head moving mechanism configured to control the thermal head if a non-printing area is longer than a first distance based on the printing data to separate the ribbon from the sheet; wherein the ribbon conveyance mechanism stops the conveyance of the ribbon if the non-printing area is longer than the first distance; and the sheet conveyance mechanism controls, if the non-printing area is longer than the first distance, the sheet conveyance speed to a second speed slower than a first speed applied in a case of conveying a printing area.

20 Claims, 5 Drawing Sheets

THERMAL PRINTER

CROSS-REFERENCE TO RELATED APPLICATIONS

This application is a Continuation of application Ser. No. 14/677,078 filed on Apr. 2, 2015, the entire contents of which are incorporated herein by reference.

FIELD

Embodiments described herein relate generally to a ribbon save processing of a thermal printer.

BACKGROUND

Conventionally, in a thermal printer which transfers ribbon to carry out printing, a control is carried out to stop the conveyance of the ribbon in a non-printing area to reduce the consumption amount of the ribbon.

It is necessary to decelerate gradually matching with the sheet conveyance speed in a case of stopping the conveyance of the ribbon. However, even in the non-printing area, the sheet is still conveyed at the same speed applied in a case of carrying out printing. As a result, much time is taken until the conveyance of the ribbon is stopped, and the ribbon is wasted during the time.

DETAILED DESCRIPTION

A thermal printer comprises a sheet conveyance mechanism configured to convey a sheet formed by attaching labels on a mount; a ribbon conveyance mechanism configured to convey a ribbon; a thermal head configured to heat the ribbon to carry out printing of printing data on the sheet contacted with the ribbon; and a head moving mechanism configured to control the thermal head if a non-printing area is longer than a first distance based on the printing data to separate the ribbon from the sheet; wherein the ribbon conveyance mechanism stops the conveyance of the ribbon if the non-printing area is longer than the first distance; and the sheet conveyance mechanism controls, if the non-printing area is longer than the first distance, the sheet conveyance speed to a second speed slower than a first speed applied in a case of conveying a printing area.

Hereinafter, one embodiment is described with reference to the accompanying drawings.

Figure 1:
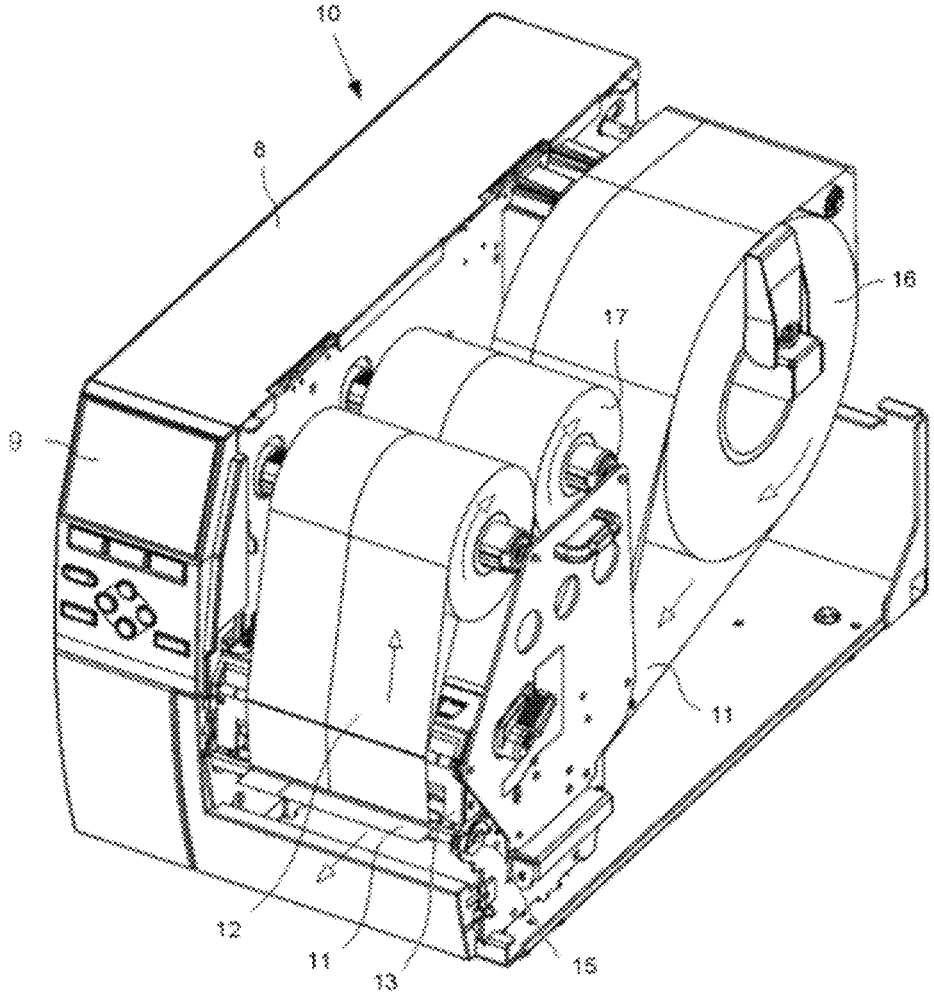
FIG. 1 is a perspective view illustrating the inside of a thermal printer.

FIG. 1 is a perspective view illustrating the inside of a thermal printer 10.

The thermal printer 10 conveys a sheet 11 (refer to FIG. 5) formed by attaching a plurality of labels 112 to a mount 111 together with a ribbon 12 for transfer between a thermal head 14 (FIG. 2) in a head moving mechanism 13 and a platen roller 15. The thermal printer 10 carries out printing on each label of the sheet 11 by the thermal head 14 across the ribbon 12 which is formed by coating ink over a base material. The thermal printer 10 prints commodity name, price, barcode and the like on each label based on printing data received from a host device.

A display 9 is arranged at the front side of a frame 8 of the thermal printer 10.

A sheet roll 16 around which the sheet 11 is wound and a ribbon roll 17 around which the ribbon 12 is wound are arranged inside the frame 8 of the thermal printer 10.

Figure 2:
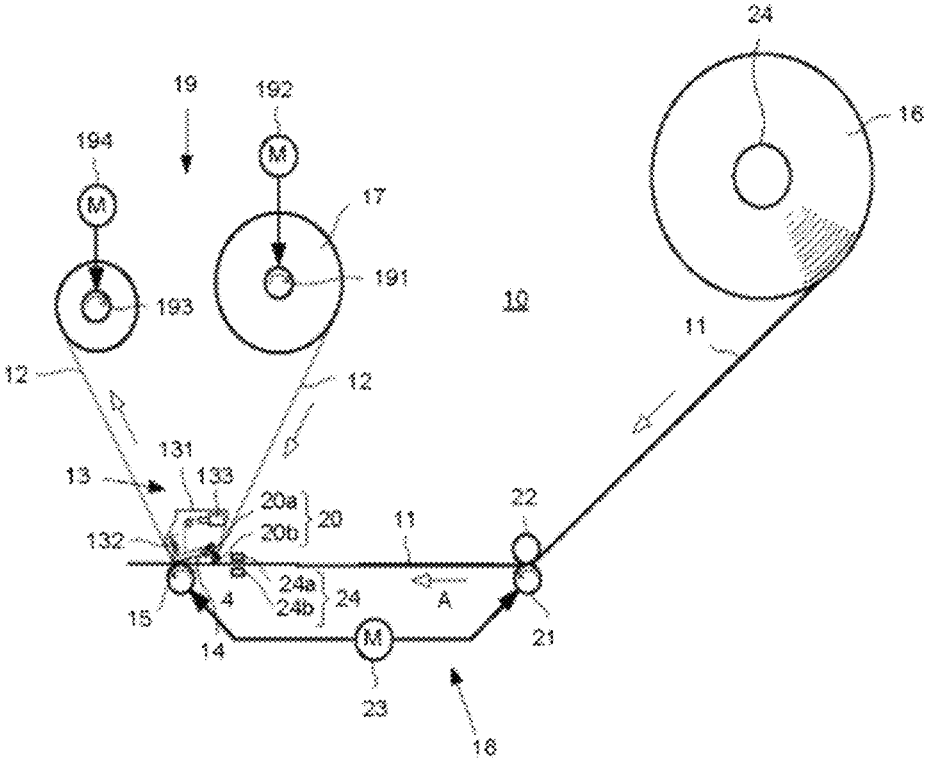
FIG. 2 is a diagram schematically illustrating the internal constitution of the thermal printer.

FIG. 2 is a diagram schematically illustrating the internal constitution of the thermal printer 10.

A sheet conveyance mechanism 18, a ribbon conveyance mechanism 19, a ribbon monitoring sensor 20, a label sensor 24 and the like are further arranged inside the thermal printer 10, in addition to the components mentioned above. Hereinafter, each component of the thermal printer 10 is briefly described.

The sheet conveyance mechanism 18 conveys the sheet 11 between the thermal head 14 and the platen roller 15. The sheet conveyance mechanism 18 is provided with the platen roller 15, a conveyance roller 21, a driven roller 22 and a conveyance motor 23. The conveyance motor 23 is a stepping motor.

The driven roller 22 nips the sheet 11 with the conveyance roller 21 and is driven to rotate through the movement of the sheet 11.

The conveyance motor 23 drives the platen roller 15 and the conveyance roller 21 through a driving force transmission module such as a belt and the like. A later-described CPU 31 (FIG. 3) can be aware of the sheet conveyance amount according to the drive step amount of the conveyance motor 23.

The ribbon conveyance mechanism 19 conveys the ribbon 12 between the thermal head 14 and the platen roller 15 at a speed equal to the sheet conveyance speed of the sheet conveyance mechanism 18. The ribbon conveyance mechanism 19 is provided with a feeding shaft 191, a back ribbon motor 192, a winding shaft 193 and a front ribbon motor 194.

The feeding shaft 191 supports a ribbon roll 17. The feeding shaft 191 rotates the ribbon roll 17 to convey the ribbon 12 between the thermal head 14 and the platen roller 15.

The back ribbon motor 192 rotates the feeding shaft 191 by interlocking with the later-described front ribbon motor 194. In the following description, the back ribbon motor 192 is controlled by interlocking with the control of the front ribbon motor 194, and the description of the specific control is not provided.

The winding shaft 193 winds the ribbon 12 that passes through the thermal head 14 and the platen roller 15.

The front ribbon motor 194 rotates the winding shaft 193.

The thermal head 14 presses the ribbon 12 against the sheet 11 on the platen roller 15. The thermal head 14 includes a plurality of heat generating elements arranged side by side at the bottom portion of the thermal head 14 in a width direction (a direction perpendicular to the paper surface in FIG. 2) of the sheet 11. The thermal head 14 selectively enables the heat generating elements to generate heat according to an instruction of the CPU 31 in a state of being pressed against the ribbon 12 to apply heat to the ribbon 12 through the heat generating element. The thermal head 14 melts or sublimates the ink of the ribbon 12 to transfer the ink to the sheet 11, thereby printing an image on the sheet 11.

The head moving mechanism 13 lifts up the thermal head 14. "Lifting up (head-up)" means moving the thermal head 14 located at a printing position shown in FIG. 2 where the ribbon 12 is pressed against the sheet in a direction (upward direction in FIG. 2) away from the platen roller 15 to a position where printing cannot be carried out.

The head moving mechanism 13 lowers the thermal head 14. "Lowering (head-down)" means moving the thermal head 14 located at a position where printing cannot be carried out in a direction (downward direction in FIG. 2) of approaching the platen roller 15 to the printing position.

The head moving mechanism 13 includes a guide frame 131, a spring 132 and a solenoid 133.

The guide frame 131 is supported by the frame 8 (FIG. 1) of the thermal printer 10.

The guide frame 131 guides the ribbon 12 between the thermal head 14 and the platen roller 15. The guide frame 131 houses the thermal head 14 at the inside thereof and holds the thermal head 14 in such a manner that one end of the thermal head 14 can be rotated. An opening portion is arranged at the bottom of the guide frame 131.

The thermal head 14 is pressed against the ribbon 12 through the opening portion. The guide frame 131 houses the spring 132 at the inside thereof and holds one end of the spring 132. The guide frame 131 houses the solenoid 133 at the inside thereof. The guide frame 131 further houses the later-described ribbon monitoring sensor 20.

The spring 132 always energizes the other end of the thermal head 14 to the platen roller 15.

The solenoid 133, if turned on, pulls up the other end of the thermal head 14 against the energization force of the spring 132 to turn the thermal head 14 into a head-up state. The solenoid 133, if turned off, releases the pulling of the other end of the thermal head 14 to turn the thermal head 14 into a head-down state.

The ribbon monitoring sensor 20, which is, for example, a transmission type sensor, consists of a light-emitting element 20*a* and a light-receiving element 20*b*. The ribbon monitoring sensor 20 emits light from the light-emitting element 20*a* to the ribbon 12 and receives the light passing through the ribbon 12 by the light-receiving element 20*b* to detect the thickness of the ribbon 12. The light-emitting element 20*a* and the light-receiving element 20*b* are arranged opposite to each other in a state of nipping the ribbon 12. The ribbon monitoring sensor may be a reflection type sensor or a combination of the transmission type sensor and the reflection type sensor. Further, the arrangement positions of the light-emitting element 20*a* and the light-receiving element 20*b* may be reversed.

The label sensor 24, which is a transmission type sensor, consists of a light-emitting element 24*a* and a light-receiving element 24*b*. The label sensor 24 emits light from the light-emitting element 24*a* to the sheet 11 and receives the light passing through the sheet 11 by the light-receiving element 24*b* to detect the boundary of the label 112 attached to the mount 111. The label sensor 24 is arranged at the upstream side of the thermal head 14 in a state of nipping the sheet 11. Further, the arrangement positions of the light-emitting element 24*a* and the light-receiving element 24*b* may be reversed.

Figure 3:
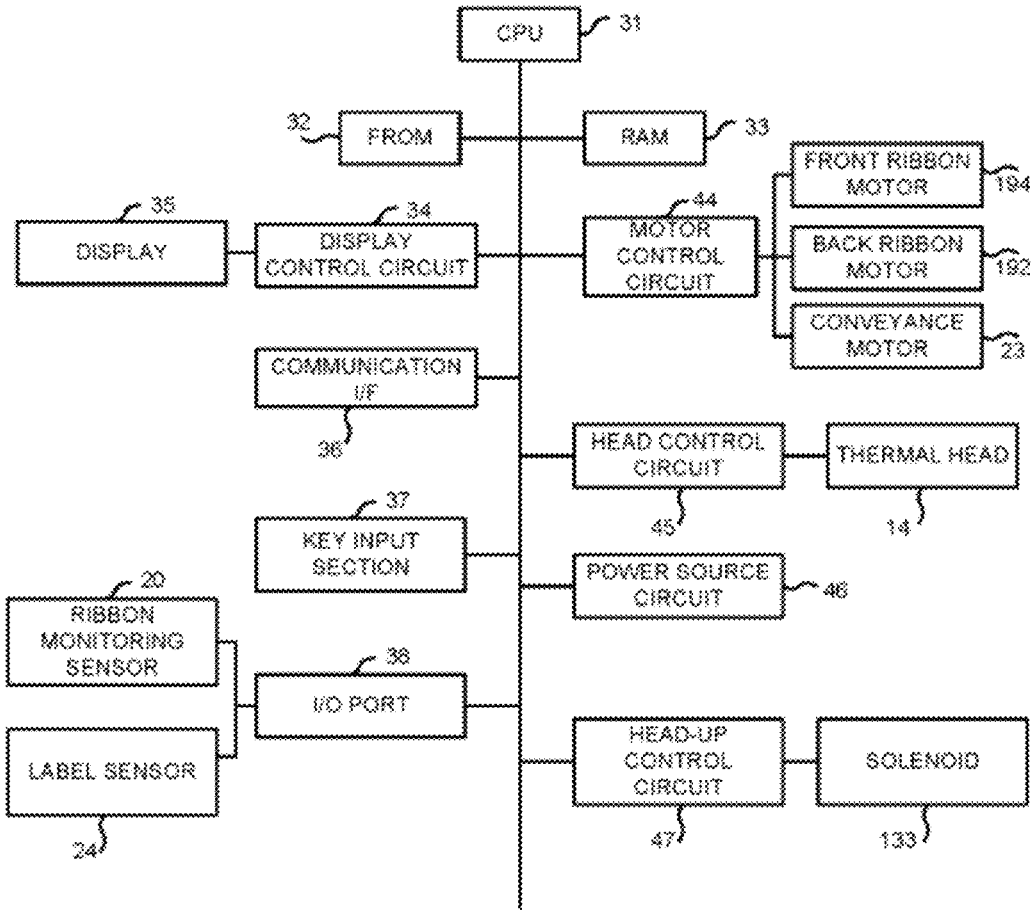
FIG. 3 is a block diagram illustrating the constitution of the thermal printer.

FIG. 3 is a block diagram illustrating the constitution of the thermal printer 10.

The CPU (Central Processing Unit) 31 serving as a controller executes a program stored in a FROM (Flash Read Only Memory) 32 to realize various functions. The FROM 32 stores a character generator and a main farm of the thermal printer 10. The FROM 32 further stores various parameters used for the control of the printer operation, and content relating to the registration of the printer and the like. The main farm in the FROM 32 controls the whole thermal printer 10 and reads font data from the character generator in which the font data is stored.

The program mentioned herein is written in the FROM 32 during the manufacturing process; however, it is not limited to this. For example, the program may be written after the manufacturing process through a CD-ROM serving as a computer-readable recording medium or other non-temporary recording medium in which the program is recorded, or a communication line.

A RAM (Random Access Memory) 33 stores the printing data and the like temporarily. The CPU 31 is also in charge of the execution of firmware stored in the main farm and the reading of the font data stored in the character generator. A display control circuit 34 controls the display 35 according to the instruction of the CPU 31.

A communication I/F 36 receives the printing data from a host device such as PC (Personal Computer) and the like connected with the thermal printer 10 through a network.

A key input section 37, consisting of an operation key and a touch panel, receives a print start instruction or a setting input of the print speed and the like from a user.

An I/O (Input/Output) port 38 includes an input port for acquiring information into the CPU 31 and an output port for sending information from the CPU 31. The I/O port 38 inputs a signal from a paper sensor 39 to the CPU 31.

A motor control circuit 44 controls the conveyance motors 23, 192 and 194 according to the instruction of the CPU 31. A head control circuit 45 controls the thermal head 14 according to the instruction of the CPU 31.

A power source circuit 46 controls the power supply to each element.

A head-up control circuit 47 turns on or turns off the solenoid 133 according to the instruction of the CPU 31 to turn the thermal head 14 into the head-up state or the head-down state.

The CPU 31 sets the print speed (conveyance speed of the sheet 11) to, for example, 3, 6, 8, 10, 12 or 14 mm/s. The CPU 31 receives the printing data including a setting value of the print speed from the host device and sets the print speed. The CPU 31 may receive the setting of the print speed at the side of the thermal printer 10.

The thermal printer 10 can use the ribbon 12 of a thickness about 0.10-0.17 mm.

Figure 4:
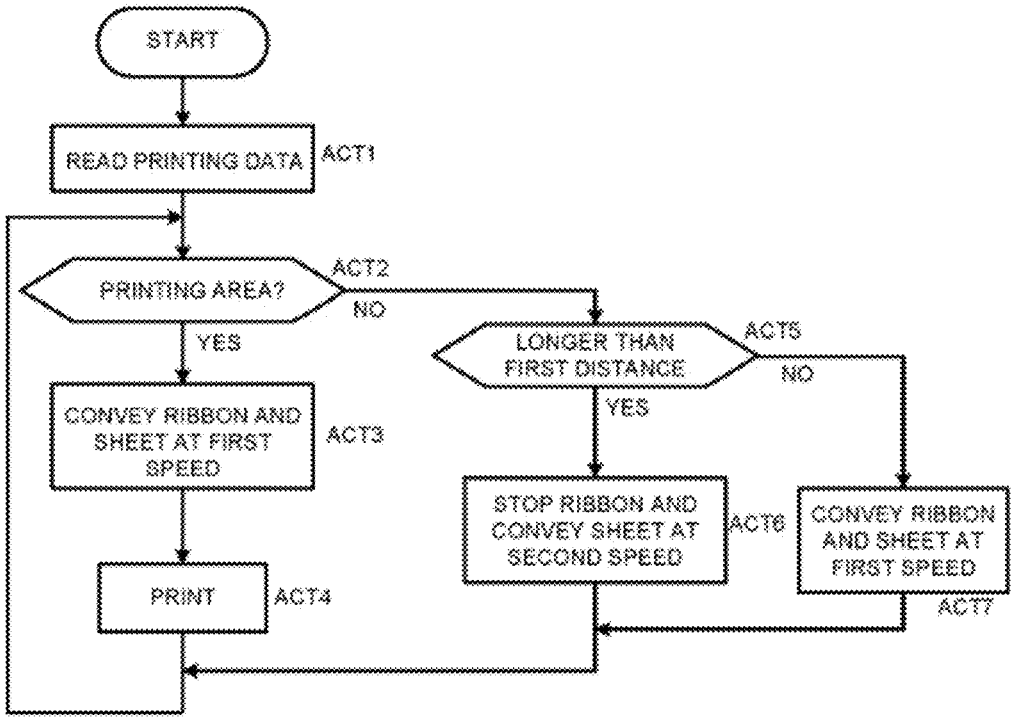
FIG. 4 is a schematic flowchart illustrating ribbon saving.

FIG. 4 is a schematic flowchart illustrating ribbon saving of the thermal printer 10 with the constitution described above.

In a case in which print request information is received, the CPU 31 reads the printing data received from the host device through the communication I/F 36 and stored in the RAM 33 (ACT 1).

The CPU 31 determines whether or not it is a printing area based on the printing data (ACT 2).

If it is determined to be the printing area in ACT 2 (YES), the ribbon 12 and the sheet 11 are conveyed at a first speed (constant speed) applied in a case of conveying the printing area (ACT 3).

Then the thermal head 14 is lowered to carry out printing on the label 112 (ACT 4).

If it is not the printing area (NO in ACT 2), the processing in ACT 5 is executed to determine whether or not the non-printing area is longer than a first distance. If the non-printing area is longer than the first distance (YES in ACT 5), the thermal head 14 is lifted up to separate the ribbon 12 from the sheet 11, the ribbon 12 is stopped, and the sheet 11 is conveyed at a second speed slower than the first speed (ACT 6).

If the non-printing area is not longer than the first distance (NO in ACT 5), the conveyance motor 23 and the front ribbon motor 194 are set to the first speed (ACT 7).

In this way, in a case in which the non-printing area other than the printing area is longer than the first distance, the sheet is conveyed while the ribbon 12 is stopped, which can reduce the ribbon consumption.

Figure 5:
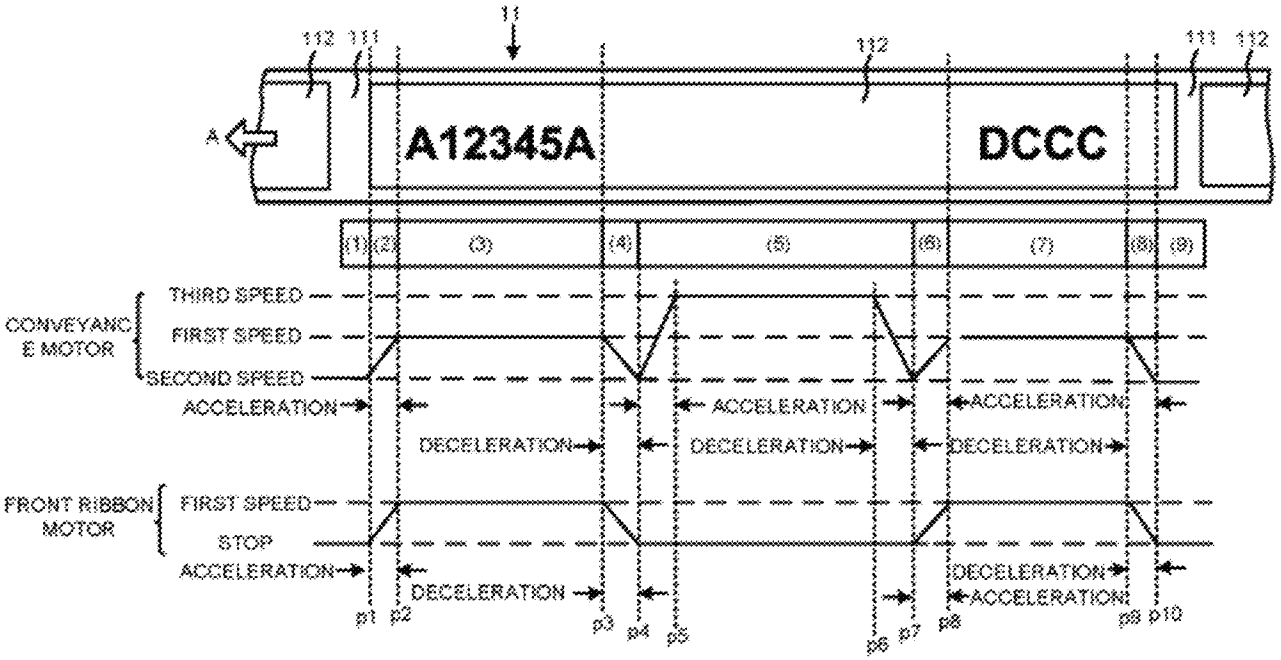
FIG. 5 is a timing chart illustrating ribbon saving.

FIG. 5 is a timing chart illustrating a specific example of ribbon saving. p1~p10 shown at the lower part of FIG. 5 indicate the relation between the control positions of the conveyance motor 23, the front ribbon motor 194 and the like with respect to the sheet 11.

It is premised that the print request information is received from the connected host device through the communication I/F 36. Herein, the print request requests the printing of "A12345A" on an area (3) and the printing of "DCCC" on an area (7) of the label 112 of the sheet 11 shown in FIG. 5.

Herein, (1) and (9) indicate an area where there is only the mount 111 without the label 112, and (2), (4)~(6) and (8) indicate the non-printing areas of the label 112. The lengths of the non-printing areas (2) and (8) are shorter than the first distance, and the non-printing area (4)~(6) is longer than the first distance serving as a distance longer than the non-printing areas (2) and (8).

First, it is premised that the conveyance motor 23 conveys the front end of the label 112 to the position of p1 and stops.

Then if the print request information is received, the CPU 31 reads the printing data received from the host device through the communication I/F 36 and stored in the RAM 33.

The CPU 31 determines whether or not the non-printing area is longer than the first distance according to the printing data. In a case of the area (2), the CPU 31 determines that the non-printing area is shorter than the first distance, and therefore lowers the thermal head 14 and accelerates the conveyance motor 23 and the front ribbon motor 194 from the position of p1 to make the conveyance speed reach the first speed at the position of p2. Between the positions of p2 and p3, the conveyance motor 23 and the front ribbon motor 194 are set to the first speed, and meanwhile, the thermal head 14 is lowered to be in the head-down state to carry out the printing of "A12345A" on the label 112.

It is determined according to the printing data that the following non-printing area (4)~(6) is the non-printing area and is longer than the first distance. Thus, when it comes to the position of p3 of the non-printing area (4), the CPU 31 lifts up the thermal head 14 to separate the ribbon 12 from the sheet 11. The front ribbon motor 194 slows down and stops. The conveyance motor 23 slows down to the second speed slower than the first speed until the position of p4. When it comes to the position of p4, the CPU 31 accelerates the conveyance motor 23 up to a third speed (high speed) higher than the first speed until the position of p5, and maintains this state until the position of p6. The third speed is, for example, twice as fast as the first speed applied in the printing operation.

When it comes to the position of p6, the CPU 31 slows the conveyance motor 23 down to the second speed before the position of p7. When it comes to the position of p7, the CPU 31 accelerates the conveyance motor 23 up to the first speed before the position of p8, and drives the front ribbon motor 194 again to accelerate the front ribbon motor 194 up to the first speed before the position of p8.

The CPU 31 controls the speed of the conveyance motor 23 and the front ribbon motor 194 to the first speed between the positions of p8 and p9, and lowers the thermal head 14 to carry out the printing of "DCCC" on the label 112.

When it comes to the position of p9 of the non-printing area (8), the CPU 31 lifts up the thermal head 14, and meanwhile slows down and stops the front ribbon motor 194 until the position of p10. The conveyance motor 23 slows down to the second speed slower than the first speed until the position of p10.

In a case in which the print request information is received next time, the same control is carried out on the conveyance motor 23 and the front ribbon motor 194 and the like.

The timing of the contact or the separation of the ribbon and the sheet does not depend on the stop of the front ribbon motor 194 or the deceleration of the conveyance motor 23. It is applicable as long as the ribbon and the sheet are separated from each other before the conveyance roller is accelerated to the third speed in a case of transiting from the printing area to the non-printing area. Similarly, it is applicable as long as the ribbon and the sheet are contacted with each other after the conveyance roller is slowed down to the second speed in a case of transiting from the non-printing area to the printing area.

Further, in a case in which the printing information of "DCCC" in the area (7) is not stored in the RAM 33, the CPU 31 slows down the conveyance motor 23 and stops the front ribbon motor 194 through the deceleration section of the area (4). In a case in which the printing position of the label 112 starts from the front end in the conveyance direction, the conveyance motor 23 and the front ribbon motor 194 are accelerated up to the first speed. The printing on the label 112 is carried out in a state in which the speed is increased up to the first speed.

In this way, in the non-printing area, the thermal head 14 is lifted up and the conveyance of the ribbon 12 is stopped, and only the sheet 11 is conveyed. When the printing area is to start again, the thermal head 14 is lowered down and the ribbon 12 is conveyed before the start of the printing area to carry out printing. In a case of conveying the sheet 11 only, the conveyance speed of the conveyance motor 23 is increased to a speed higher than the first speed; and it is returned to the printing speed of the first speed before the thermal head 14 is lowered before the next printing processing.

Through such an operation, the time taken for the stop of the front ribbon motor 194 can be reduced, which can reduce the consumption amount of the ribbon. Further, the sheet is conveyed at a high speed in the non-printing area (the area between characters), which contributes to the reduction of the printing completion time.

The present invention is not limited to the embodiment described above. For example, it is exemplified that the conveyance motor 23 is slowed down to the second speed until the position of p4 in the area (4); however, the conveyance motor 23 may be stopped temporarily. Similarly, it is exemplified that the conveyance motor 23 is slowed down to the second speed until the position of p7 in the area (6); however, the conveyance motor 23 may be stopped temporarily.

Further, the deceleration time is set to be shorter than the acceleration time. The printing is not carried out during the deceleration time, thus, a brake may be used to facilitate the stop. Sometimes, the printing is carried out during the acceleration process according to the printing position of the label, thus, time is needed for the head-down, and the acceleration time in this case needs to be set to be longer than the deceleration time.

In a case in which the non-printing area is longer than a second distance longer than the first distance, the speed is controlled to a fourth speed higher than the third speed. In this case, the ribbon consumption can be further reduced in a case of a longer non-printing area.

Moreover, for example, in a case of setting the time taken in the printing to a constant value without regard to the printing data, the sheet conveyance speed in the non-printing area may be changed based on the printing data.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A thermal printer comprising:

a sheet conveyance mechanism configured to convey a sheet formed by attaching labels on a mount at a first speed applied in a case of conveying a printing area;

a ribbon conveyance mechanism configured to convey a ribbon;

a thermal head configured to heat the ribbon to print printing data on the sheet; and a head moving mechanism configured to control the thermal head to separate the ribbon from the sheet in a case in which a non-printing area is longer than a first distance; wherein the ribbon conveyance mechanism configured to stop the conveyance of the ribbon in a case in which the non-printing area is longer than the first distance, the sheet conveyance mechanism configured to control the conveyance speed to a third speed higher than the first speed in a case in which the head moving mechanism separates the ribbon from the sheet, and the head moving mechanism configured to separate the ribbon from the sheet when the conveyance speed of the sheet is reduced down to the second speed.

2. The thermal printer, described in claim 1, wherein the sheet conveyance mechanism configured to control the conveyance speed to a second speed lower than the first speed in a case in which the non-printing area is longer than the first distance.

3. The thermal printer, described in claim 1, wherein the sheet conveyance mechanism configured to stop the conveyance of the sheet in a case in which the non-printing area is longer than the first distance.

4. The thermal printer, described in claim 1, wherein the head moving mechanism configured to separate the ribbon from the sheet when the conveyance of the sheet is stopped.

5. The thermal printer, described in claim 1, wherein the sheet conveyance mechanism configured to control the conveyance speed of the sheet to the second speed and then to the first speed in a case of conveying the sheet from the non-printing area to the printing area.

6. The thermal printer, described in claim 1, wherein the sheet conveyance mechanism configured to stop the conveyance of the sheet and then control the conveyance speed of the sheet to the first speed in a case of conveying the sheet from the non-printing area to the printing area.

7. The thermal printer, described in claim 1, further comprising:

a central processing unit to control speed of the sheet conveyance mechanism.

8. The thermal printer, described in claim 7, wherein the central processing unit increases the speed of the sheet conveyance mechanism.

9. The thermal printer, described in claim 7, wherein the central processing unit decreases the speed of the sheet conveyance mechanism.

10. The thermal printer, described in claim 1, further comprising:

a central processing unit to control speed of the ribbon conveyance mechanism.

11. The thermal printer, described in claim 10, wherein the central processing unit increases the speed of the ribbon conveyance mechanism.

12. The thermal printer, described in claim 10, wherein the central processing unit decreases the speed of the ribbon conveyance mechanism.

13. A method of controlling a conveyance speed of a thermal printer being comprised of a sheet conveyance mechanism configured to convey a sheet formed by attaching labels on a mount, a ribbon conveyance mechanism configured to convey a ribbon, a thermal head configured to heat the ribbon to print printing data on the sheet, and a head moving mechanism configured to control the thermal head to separate the ribbon from the sheet in a case in which a non-printing area is longer than a first distance:

stopping the conveyance of the ribbon in a case in which the non-printing area is longer than the first distance;

controlling the conveyance speed to a third speed higher than the first speed in a case in which the head moving mechanism separates the ribbon from the sheet;

controlling the conveyance speed to a second speed lower than the first speed in a case in which the non-printing area is longer than the first distance; and separating the ribbon from the sheet when the conveyance speed of the sheet is reduced down to the second speed.

14. The method of controlling the conveyance speed described in claim 13:

stopping the conveyance of the sheet in a case in which the non-printing area is longer than the first distance.

15. The method of controlling the conveyance speed described in claim 13:

controlling the conveyance speed of the sheet to the second speed and then to the first speed in a case of conveying the sheet from the non-printing area to the printing area.

16. The method of controlling the conveyance speed described in claim 13:

stopping the conveyance of the sheet and then control the conveyance speed of the sheet to the first speed in a case of conveying the sheet from the non-printing area to the printing area.

17. A method of controlling a conveyance speed of a thermal printer being comprised of a sheet conveyance mechanism configured to convey a sheet formed by attaching labels on a mount, a ribbon conveyance mechanism configured to convey a ribbon, a thermal head configured to heat the ribbon to print printing data on the sheet, and a head moving mechanism configured to control the thermal head to separate the ribbon from the sheet in a case in which a non-printing area is longer than a first distance:

stopping the conveyance of the ribbon in a case in which the non-printing area is longer than the first distance;

controlling the conveyance speed to a third speed higher than the first speed in a case in which the head moving mechanism separates the ribbon from the sheet;

stopping the conveyance of the sheet in a case in which the non-printing area is longer than the first distance; and separating the ribbon from the sheet when the conveyance of the sheet is stopped.

18. The method of controlling the conveyance speed described in claim 17:

controlling the conveyance speed to a second speed lower than the first speed in a case in which the non-printing area is longer than the first distance.

19. The method of controlling the conveyance speed described in claim 17:

controlling the conveyance speed of the sheet to the second speed and then to the first speed in a case of conveying the sheet from the non-printing area to the printing area.

20. The method of controlling the conveyance speed described in claim 17:

stopping the conveyance of the sheet and then control the conveyance speed of the sheet to the first speed in a case of conveying the sheet from the non-printing area to the printing area.

* * * * *